US010111529B2

(12) United States Patent
Ray

(10) Patent No.: US 10,111,529 B2
(45) Date of Patent: Oct. 30, 2018

(54) SINGLE-UNIT CONVERTIBLE BED, DESK, AND COUCH FURNITURE WITH EXTENSIBLE BED FRAME

(71) Applicant: Steven Rockwell Ray, Benicia, CA (US)

(72) Inventor: Steven Rockwell Ray, Benicia, CA (US)

( * ) Notice: Subject to any disclaimer, the term of this patent is extended or adjusted under 35 U.S.C. 154(b) by 0 days.

(21) Appl. No.: 14/626,864

(22) Filed: Feb. 19, 2015

(65) Prior Publication Data

US 2016/0242556 A1 Aug. 25, 2016

(51) Int. Cl.

| | |
|---|---|
| ***A47C 17/52*** | (2006.01) |
| ***A47C 17/62*** | (2006.01) |
| ***A47C 17/17*** | (2006.01) |
| ***A47C 17/20*** | (2006.01) |
| ***A47C 17/54*** | (2006.01) |
| ***A47B 83/00*** | (2006.01) |
| ***A47B 83/04*** | (2006.01) |
| ***A47B 85/06*** | (2006.01) |
| ***A47C 19/22*** | (2006.01) |
| ***A47C 17/58*** | (2006.01) |

(52) U.S. Cl.

CPC ..... *A47C 17/52* (2013.01); *A47B 83/00* (2013.01); *A47B 83/04* (2013.01); *A47B 85/06* (2013.01); *A47C 17/17* (2013.01); *A47C 17/20* (2013.01); *A47C 17/54* (2013.01); *A47C 17/58* (2013.01); *A47C 17/62* (2013.01); *A47C 19/22* (2013.01)

(58) Field of Classification Search

CPC ..... A47C 17/00; A47C 17/04; A47C 17/17; A47C 17/20; A47C 17/136; A47C 17/1655; A47C 17/52; A47C 17/54; A47C 17/58; A47C 17/62; A47C 19/22; A47B 83/00; A47B 83/001; A47B 83/04; A47B 85/00; A47B 85/06; A47B 83/02

See application file for complete search history.

(56) References Cited

U.S. PATENT DOCUMENTS 2,532,355 A * 12/1950 Brown ..... A47C 17/136 312/311
3,337,879 A * 8/1967 Humphrey ..... A47C 17/62 108/13
3,386,110 A * 6/1968 Vanhentenrijk ..... A47B 85/00 297/118

(Continued)

*Primary Examiner* — Nicholas F Polito
*Assistant Examiner* — David R Hare

(57) ABSTRACT

A convertible furniture piece is disclosed, having a bed configuration, desk configuration, and couch configuration. The furniture includes an outer frame that houses a bed frame and desk, along with the mechanism for raising and lowering the bed frame and desk. The outer frame, bed frame, and desk are interconnected such that the bed frame and desk transition together between a bed configuration, where the desk sits directly below the bed frame, and desk configuration, where the bed frame is stored vertically, while keeping the desk level with the floor. The furniture may be converted to a couch by repositioning a foldable mattress topper as a backrest against the outer frame while the bed frame is horizontal. The furniture may further comprise a bed frame extension, allowing the foldable mattress topper to be repositioned as a second mattress alongside a first mattress.

16 Claims, 8 Drawing Sheets

(56) References Cited

U.S. PATENT DOCUMENTS 4,070,715 A * 1/1978 Reppas ..... A47C 17/62 312/241
4,318,195 A * 3/1982 Reppas ..... A47B 85/00 312/240
4,476,592 A * 10/1984 Reppas ..... A47C 17/40 5/136
4,506,927 A * 3/1985 Lombardo ..... A47C 13/00 297/118
4,793,011 A * 12/1988 Eve ..... A47C 17/58 5/136
5,038,421 A * 8/1991 Harris ..... A47C 17/132 5/12.1
5,101,523 A * 4/1992 Bright ..... A47C 17/38 108/39
5,522,097 A * 6/1996 Ciccotelli ..... A47C 17/04 5/2.1
6,088,849 A * 7/2000 Lieber ..... A47B 85/08 312/315
6,401,276 B1 * 6/2002 Sherman ..... A47B 5/06 5/133
6,508,526 B2 * 1/2003 Reppas ..... A47B 21/0073 312/223.3
6,779,208 B2 * 8/2004 Lim ..... A47C 17/48 5/136
7,017,201 B2 * 3/2006 Lin ..... A47C 17/62 5/2.1
8,375,483 B2 * 2/2013 Ray ..... A47C 7/62 5/12.1
8,418,282 B2 * 4/2013 Luft-Weissberg ..... A47B 83/00 108/33
9,259,086 B2 * 2/2016 Wong ..... A47C 17/165
2003/0167566 A1 * 9/2003 Inagaki ..... A47C 17/161 5/18.1
2005/0229307 A1 * 10/2005 Monestier ..... A47C 17/62 5/3
2008/0016617 A1 * 1/2008 Plantefever ..... A47B 85/06 5/3
2008/0163421 A1 * 7/2008 Stonier ..... A47C 17/46 5/2.1
2011/0167558 A1 * 7/2011 Harris ..... A47C 17/2073 5/18.1

* cited by examiner

SINGLE-UNIT CONVERTIBLE BED, DESK, AND COUCH FURNITURE WITH EXTENSIBLE BED FRAME

BACKGROUND

Field of the Technology

The disclosure relates to the field of convertible furniture, single units that readily convert between two or more furniture functions. This application is for a single-unit furniture piece that may be converted between a bed, desk, and couch.

USPC: 5/2.1, 5/3, 5/7, 5/12.1, 5/17, 5/18.1, 5/32.1

Background of the Invention

Traditional furniture pieces are single-purpose items. For many consumers, having single-purpose furniture is not ideal because of space limitations within the home or workspace. Convertible or combination furniture pieces aim to solve this problem by efficiently using the limited available space to serve multiple functions. Current convertible furniture such as those disclosed in U.S. Pat. No. 7,140,052 and U.S. Pat. No. 4,070,715 combine bed and desk functions into one space-saving unit. U.S. Pat. No. 7,140,052 and U.S. Pat. No. 4,070,715 are incorporated herein in their entireties. Such furniture have several disadvantages. First, in order to allow large items such as computer monitors and speakers to remain on the desk while the furniture is in the bed configuration, the bed frame must have a considerable height. Such height is uncomfortable and awkward for a practical bed. Such furniture cannot be configured to provide a third couch function in addition to a bed and desk. Furthermore, such furniture have narrow bed frames in order to accommodate the desk portion stored beneath the bed frame.

BRIEF SUMMARY

Embodiments of the present invention address these problems by providing a third couch configuration in addition to the bed and desk configurations by providing a foldable mattress topper that serves as a traditional mattress topper, couch backrest cushion, second mattress, and by providing an extensible bed frame. A bed frame in pivotally attached to a larger, external frame that houses the entire convertible furniture piece. A desktop is also pivotally attached to the underside of the bed frame such that when the bed frame rotates upward, the bed frame pulls the desktop up to an elevated position. The desktop also remains substantially level with the floor during this transition. The embodiment may be converted from the bed to the couch configuration by folding the mattress topper in half and repositioning it as a couch backrest. A bed frame extension also included with the embodiment of the invention. Such bed frame extension may be pivotally or slidably attached to the bed frame, or it may be separate from the bed frame, in which case it may be positioned adjacent to the bed frame to provide the extension. The folded mattress topper may be repositioned as a second mattress to cover the extended bed frame.

The embodiments include an item of furniture convertible between day bed, desk, and couch configurations used on combination with a configurable mattress-cushion. The item includes an external box frame having two opposing sides and a backrest and having a low profile consistent with a profile of a conventional couch; a bed frame rotatably coupled to the external box frame; and a desktop rotatably coupled to the bed frame and disposed below the bed frame such that the desktop is raised or lowered when the bed frame is raised or lowered respectively. When in a lowered configuration the bed frame serves as a supporting surface for a day bed or a seating surface for a couch in combination with the box frame depending on placement and configuration of the mattress-cushion on the bed frame and box frame. When in a raised configuration the bed frame is rotated into a vertical storage position and the desktop is raised to a desktop height within the box frame while remaining horizontally oriented.

In particular, the illustrated embodiments of the invention include an item of furniture convertible between a bed, desk, and couch. The item includes an external frame; a bed frame rotatably coupled to the external frame; a desktop rotatably coupled to the bed frame such that the desktop is raised or lowered when the bed frame is raised or lowered respectively and such that the desktop remains horizontally oriented while it is being raised or lowered; a mattress and/or a foldable mattress topper; a bed frame extension capable of being coupled to the bed frame; and a supporting member for supporting the bed frame extension. The furniture has a couch configuration where the foldable mattress topper is repositioned as a backrest, a bed frame extension and a supporting member such that the foldable mattress and/or a foldable mattress topper is capable of being configured to fore a larger sleeping area in the bed configuration.

The foldable mattress topper includes a first layer of viscoelastic foam; a second layer of high density foam; and a longitudinal foldable connection separating two equal-sized sections of the layers of foam, such that the mattress topper may fold in half lengthwise.

The mattress topper includes a first layer of viscoelastic foam; a second layer of foam having higher elasticity than the first layer; and a longitudinal foldable connection separating two equal-sized sections of the layers of foam, such that the mattress topper may fold in half lengthwise.

The furniture further includes a hinge connecting the bed frame extension to the bed frame.

The bed frame extension is a slatted surface that slides out of the bed frame.

In another embodiment the furniture is convertible between a bed, desk, and couch, and includes an external frame having two opposing side walls and an inner wall; a bed frame pivotally connected to the external frame; a mattress placed on the bed frame; a desk, having a rectangular surface extending from the inner wall; means to raise and lower the desk when rotating the bed frame between vertical and horizontal positions while keeping the desk substantially horizontal; and a foldable mattress topper. The furniture is capable of assuming a couch configuration when the foldable mattress topper is folded and placed against the inner wall of the external frame and on top of the mattress when in a bed configuration.

The means to raise and lower the desk includes a first pivot connecting the bed frame to the external frame; a second pivot connecting the desk to the underside of the bed frame; a connecting rod; a third pivot connecting the desk to one end of the connecting rod; and a fourth pivot connecting an opposing end of the connecting rod to the external frame so that a parallelogram linkage is formed.

The furniture further includes a bed frame extension surface movable relative to the bed frame; and at least two support legs pivotally attached to the bed frame extension surface.

The furniture further includes a bed frame extension surface and a support member moveable relative to the bed frame including one or more storage containers such that the bed frame extension may rest on top of the support member coplanar with the surface of the bed frame.

In still another embodiment the furniture is convertible between a single-bed configuration, a larger, extended-bed configuration, a desk, and a couch or daybed, and includes an external frame having at least two opposing side walls and one inner wall; a mattress; a foldable mattress topper; a bed frame for holding the mattress and the foldable mattress topper, the bed frame being pivotally connected to the external frame capable of being configured into a bed configuration; a desk having a horizontal surface extending from the inner wall; a parallelogram linkage to raise and lower the desk such that the desk is in an elevated use position when the bed frame is rotated vertically and the desk is in a lower storage position when the bed frame is horizontal, and such that the desk remains horizontal during the transition. A couch configuration is obtained when the foldable mattress topper is repositioned as a backrest against the inner wall when in the bed configuration. A bed frame extension surface is moveable relative to the bed frame to a deployed configuration; and at least one support member to maintain the bed frame extension surface coplanar with the bed frame when moved to the deployed configuration.

The bed frame extension surface is a supporting surface that folds out of the bed frame or a supporting surface that slides out of the bed frame.

The at least one support member is selected from the group consisting of storage container or furniture legs.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

Figure 1A:
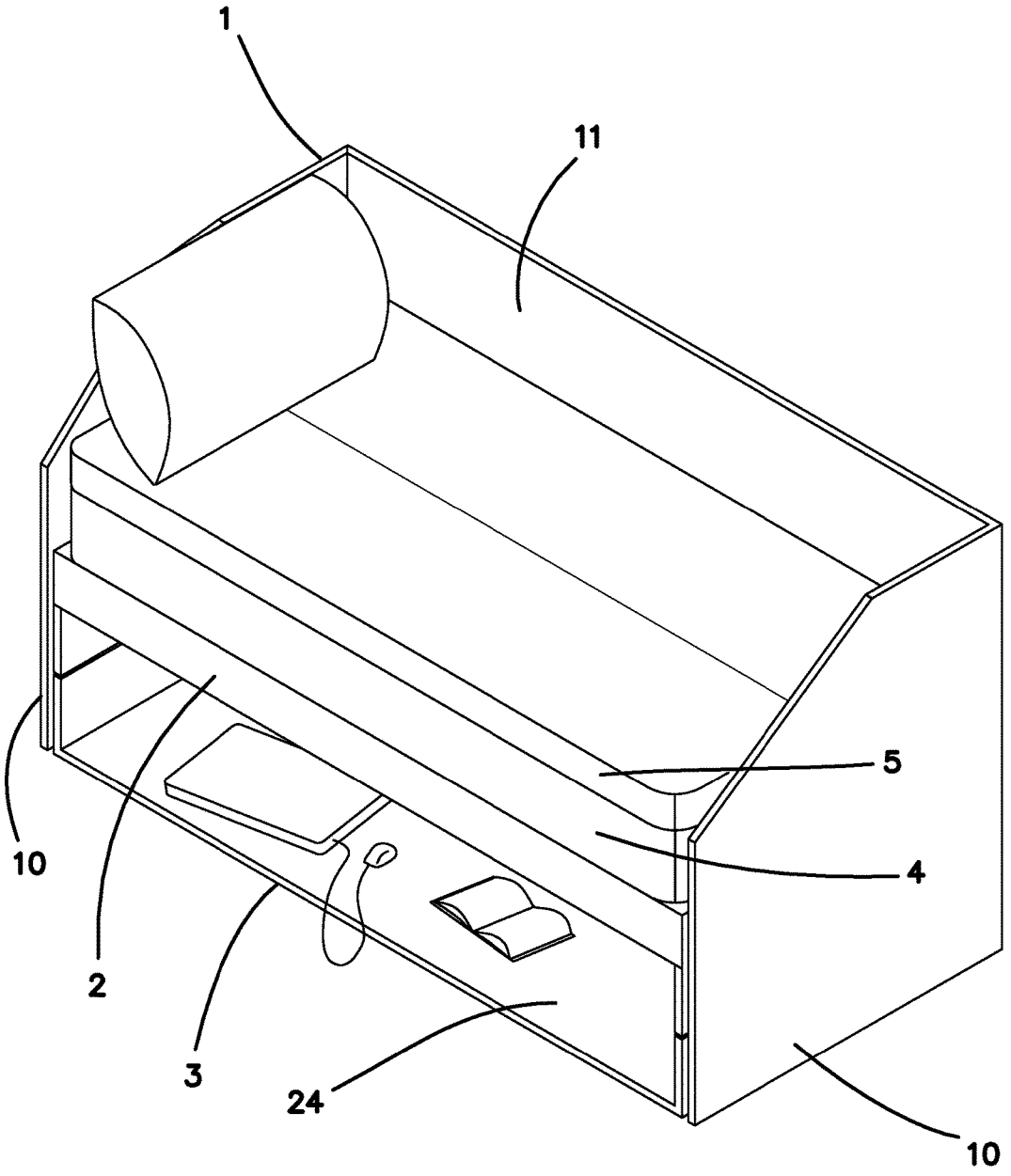
FIG. 1A is a front perspective view of an embodiment of the present invention in the bed configuration.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

The following description is merely example in nature and is not intended to limit the present disclosure, application, or uses. It should be understood that throughout the drawings, corresponding reference numerals indicate like or corresponding parts and features.

Figure 2:
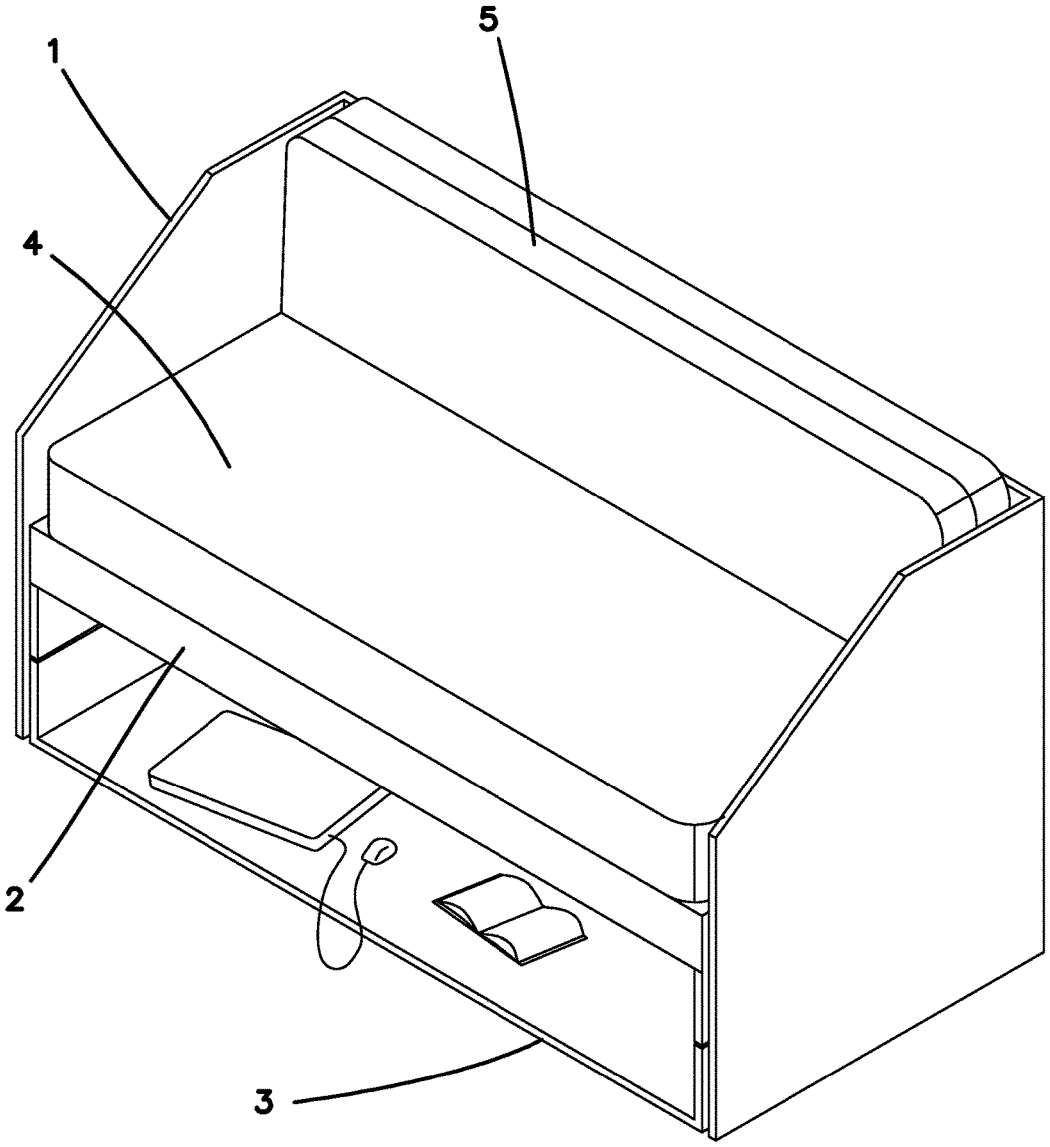
FIG. 2 is a front perspective view of an embodiment of the FIGS. 1A and 1B in the couch configuration.
Figure 3:
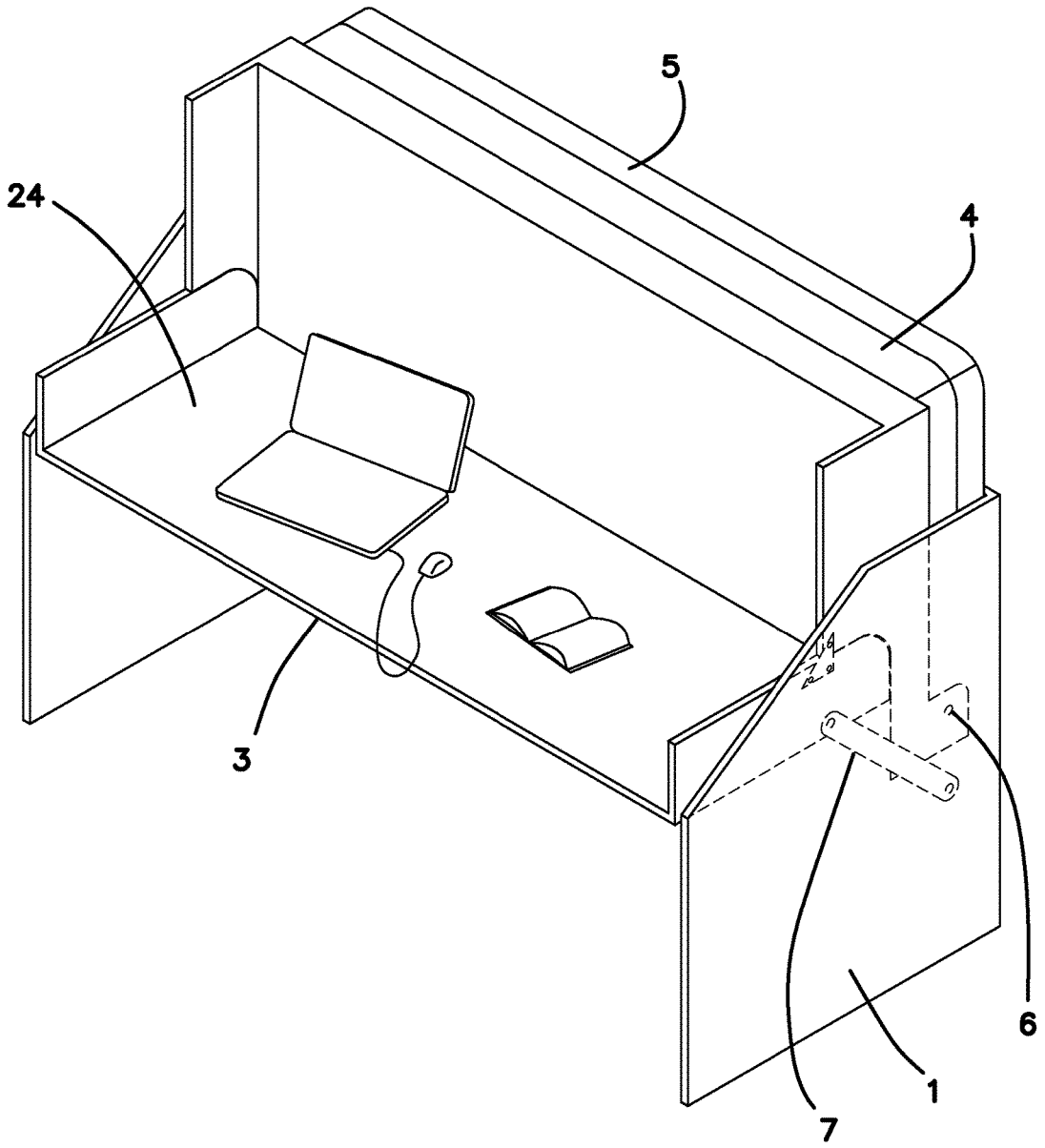
FIG. 3 is a front perspective view of an embodiment of the FIGS. 1A and 1B in the desk configuration.

A preferred embodiment of the present invention is shown in FIGS. 1A, 2, and 3, in the single-bed, couch, and desk configurations, respectively. The preferred embodiment has an external frame, 1, as shown in FIGS. 1A, 2, and 3. The external frame 1 is constructed out of wood, metal, plastic, fiberglass, a combination thereof, or another material having similar structural integrity. The external frame 1 has at least three faces: two opposing side walls 10 and one inner or rear wall 11 connecting side walls 10. The external frame 1 may have additional features such as storage containers or decorative features.

Figure 1B:
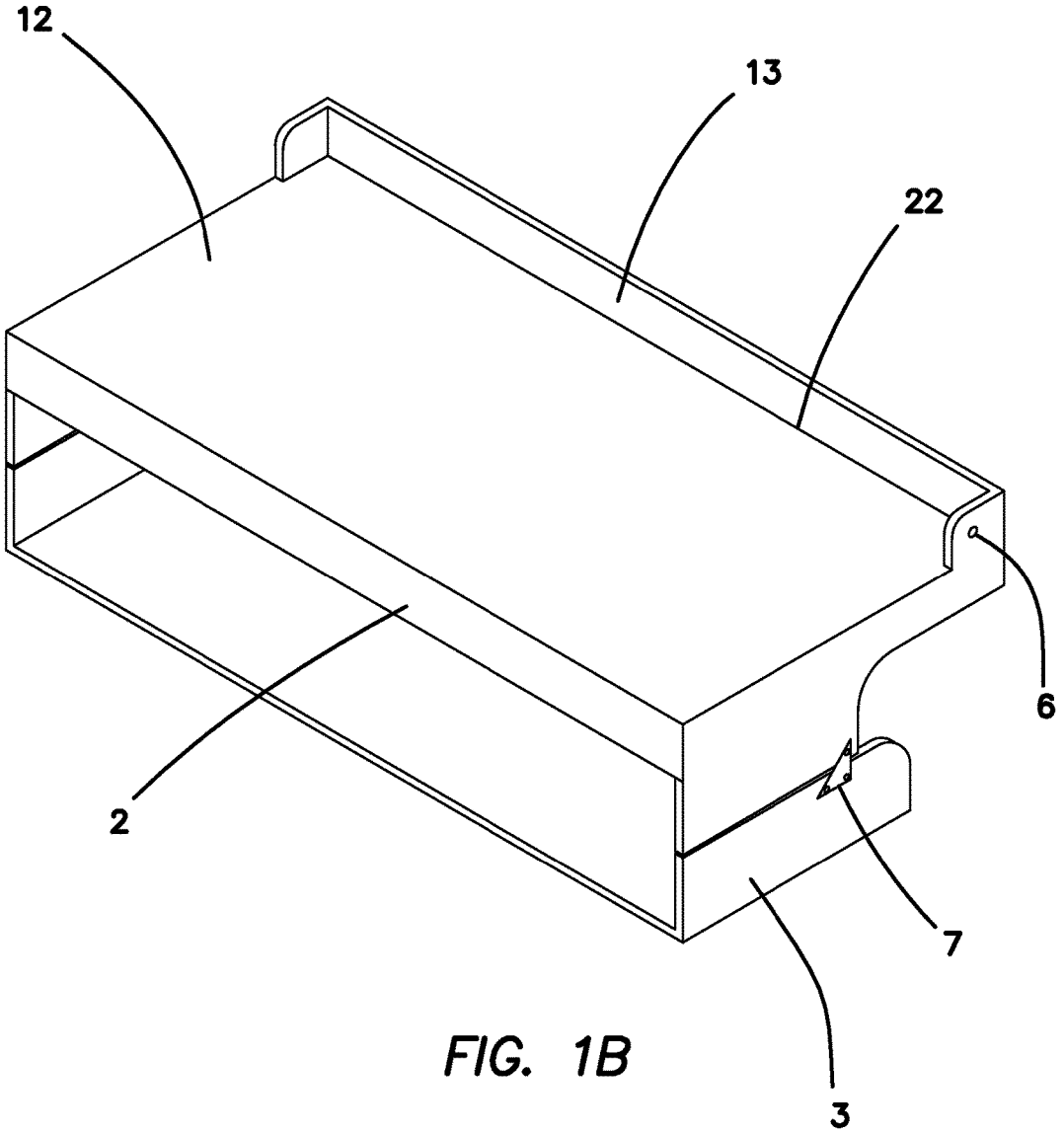
FIG. 1B is a side perspective view of the bed frame portion of the embodiment described in FIG. 1A.

Referring to FIGS. 1A and 1B, a bed frame 2 is disposed horizontally within and across the external frame 1, extending from one side wall 10 to the opposing side wall 10. The bed frame 2 has an upper surface 12 that is horizontally oriented when in the bed use configuration and at least one raised rear retaining wall 13 provided along a rear edge 22 of upper surface 12 in order to prevent a mattress from falling or sliding off of bed frame 2 when the bed frame 2 is in its vertical storage position. The upper surface 12 is a solid surface or a surface made of parallel wood slats or other open lattice to reduce weight. The bed frame 2 is pivotally attached by a hinge 6 attached to the external frame so that the bed frame 2 may rotate between a horizontal use position and a vertical storage position. A desk 3 with a horizontal surface 24 extends disposed within the external frame 1 and under bed frame 2 as shown in FIG. 1A is also pivotally attached to the underside of the bed frame 2 in a manner similar to that shown for pivoted attachment of bed frame 2 to external frame 1. In the single bed configuration, the desk surface 24 is disposed below the bed frame 2. A mattress 4 and a foldable mattress topper 5 are positioned on the bed frame 2, with the foldable mattress topper 5 laid above the mattress 4.

Converting the preferred embodiment from the bed to the couch configuration as depicted in FIG. 2 involves folding the foldable mattress topper 5 in half and placing it vertically on the mattress 4 and against the rear inner wall 11 of the external frame 1. The desk surface 24 remains below the bed frame 2. The bed frame 2 combined with the mattress 4 will typically have a height sufficient to allow comfortable use as a couch. As will be explained in further detail below, the mattress topper 5 has a thickness of half the thickness of the mattress 4.

Figure 4A:
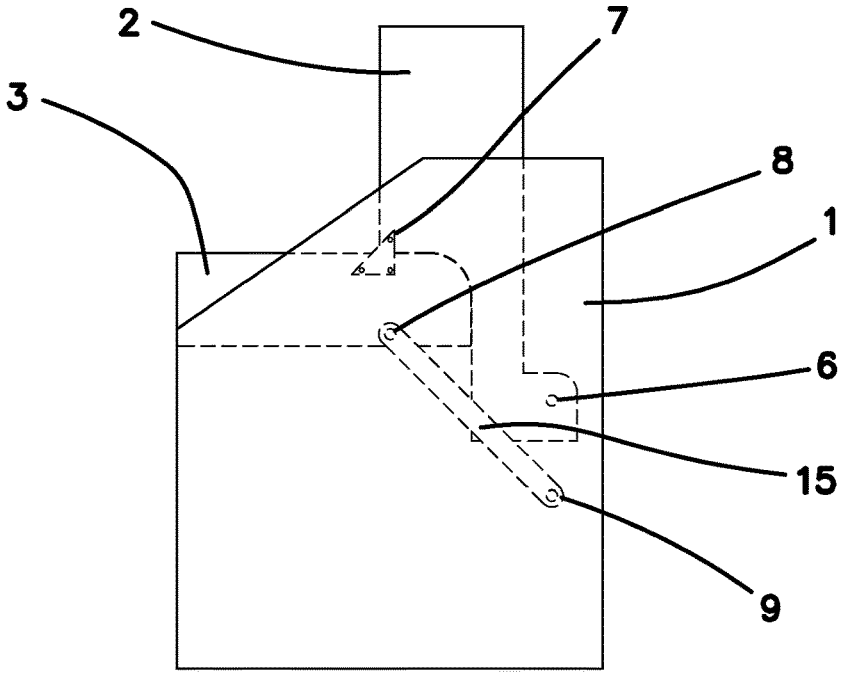
FIG. 4A is a side plan view of an embodiment of FIGS. 1A and 1B in the desk configuration.

FIG. 3 depicts the preferred embodiment in the desk configuration. The desk consists of a horizontal surface 3 extending away from the inner wall of the external frame. The desktop 3 is pivotally attached by pivot 7 shown in FIG. 1B to the bed frame 2 and thus indirectly to the external frame 1 such that when the bed frame 2 is rotated vertically, the desk surface 24 is elevated to its desk use position. In the preferred embodiment, the desktop 3 is connected to the external frame 1 by a connecting rod 15 as best depicted in FIG. 4A and the desktop 3 is connected to the bed frame 2 by a pivot 7. Referring to FIG. 4A, the points of rotatable connection between pivot 6 around which the bed frame 2 rotates with respect to the external frame 1, pivot 7 around which the bed frame 2 and the desktop 3 rotate, pivot 8 rotatably connected to the desktop 3 at one end of the connecting rod 15, and pivot 9 rotatably connected to external frame 1 at the other end of the connecting rod 15 form a parallelogram linkage. Other embodiments of the invention may use other methods of connecting the desktop 3, bed frame 2, and external frame 1 such that the same resulting transition is achieved in which the desktop's upper surface 24 is maintained in a horizontally level orientation as it is raised into the final position in the desk configuration as depicted in FIG. 3. For this reason items that may be placed or stored on surface 24 will not be displaced or shift in position as the desktop 3 is reconfigured into the desk configuration.

Figure 4B:
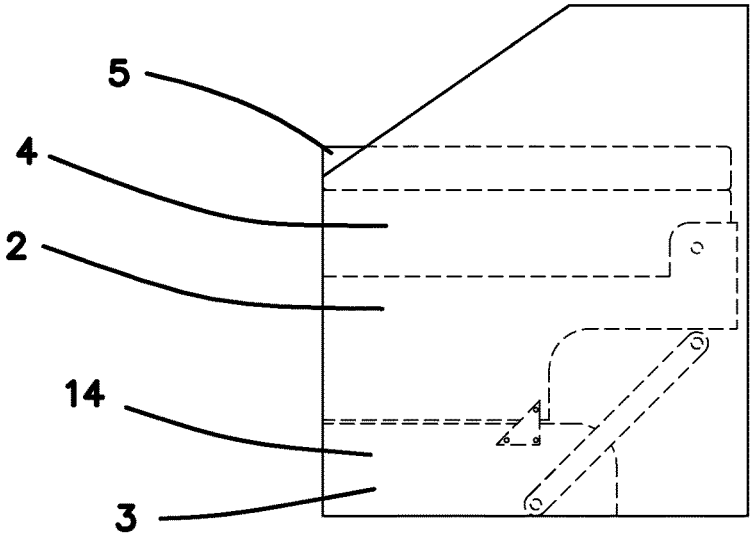
FIG. 4B is a side plan view of an embodiment of FIGS. 1A and 1B in the single bed configuration.

FIG. 4B shows a side cutaway view of the preferred embodiment in the single bed configuration. In this view, the bed frame 2 is disposed horizontally with the mattress 4 and foldable mattress topper 5 on top also horizontal. The desktop 3 sits below the bed frame 2, on the floor. The desktop 3 has two opposing raised side edges 14 closest to the two adjacent sides of the external frame 1. The bottom side portions of bed frame 2 may rest on these raised edges 14 of the desktop 3 to provide additional support.

Figure 4C:
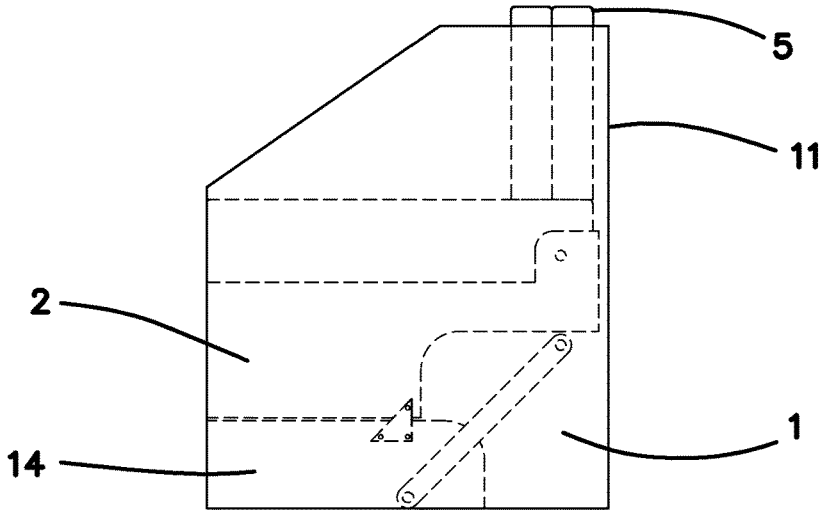
FIG. 4C is a side plan view of an embodiment of FIGS. 1A and 1B in the couch configuration.

FIG. 4C shows a side cutaway view of the preferred embodiment in the couch configuration. In this configuration, the bed frame 2 is horizontal and resting on the raised edges 14 of the desktop surface 24. The foldable mattress topper 5 is folded and placed against the rear inner wall 11 of the external frame 1 to form a backrest.

Figure 5A:
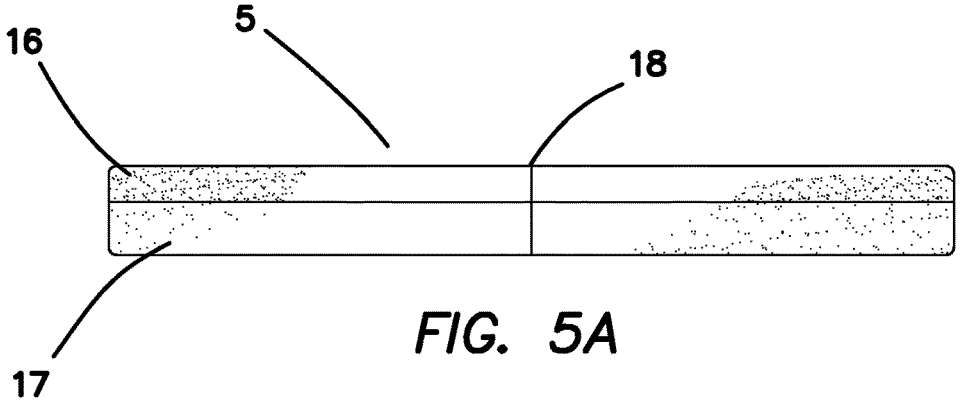
FIG. 5A is a side plan view of a foldable mattress topper as part of an embodiment of the present invention shown in an unfolded or flat configuration.
Figure 5B:
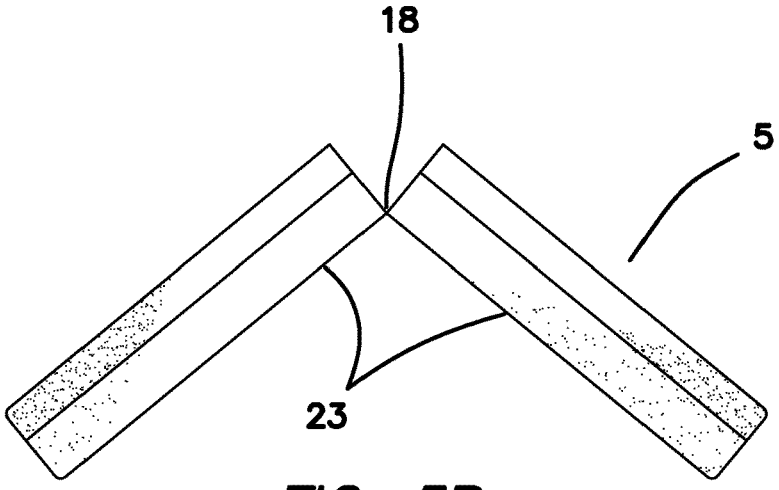
FIG. 5B is a side plan view of the foldable mattress topper of FIG. 5A shown in a partially folded or open configuration.

FIG. 5A shows a side cross sectional view of the foldable mattress topper 5. The mattress topper 5 is comprised of either a single cushioning material or at least two layers of different cushioning materials. In the preferred embodiment, at least one layer 16 is comprised of a viscoelastic foam. The density of the viscoelastic foam may range from about 1 pound per cubic foot to 6 pounds per cubic foot. A viscoelastic foam of about 4 pounds per cubic foot provides a more comfortable and higher quality feel to the mattress topper. A second layer 17 of the mattress topper 5 is made of a foam having a higher indentation force deflection ("IFD") than the first layer. Indentation force deflection is a measure of a cushion's firmness and is defined as the force (in pounds) required to indent a fifty square inch, round indentor foot into a foam specimen a certain percentage of the specimen's total thickness (i.e. 25%, 50%). Thus, by having a higher IFD score, the second layer 17 of foam provides firm support for body weight, whereas the first layer with lower IFD provides a very soft feel for the user. A second layer of foam having higher elasticity or density than the first layer would also work as intended to provide body weight support. The mattress topper 5 is also divided into two equally sized sections 23 as depicted in FIG. 5B, with the division 18 running lengthwise along the longitudinal direction of mattress topper 5. The two sections 23 are connected by a sewn hinge 18 or other connection allowing the two sections to fold together. When the foldable mattress topper 5 is unfolded, it covers the mattress to be used as additional cushioning. Each equal sized section 23 has the same length as the mattress 4, half the width of the mattress 4, and half the thickness of the mattress 4. Although not depicted in the preferred embodiment, the mattress topper 5 and mattress 4 may be a single unit where the mattress topper 5 and mattress 4 are connected or otherwise combined.

Figure 6:
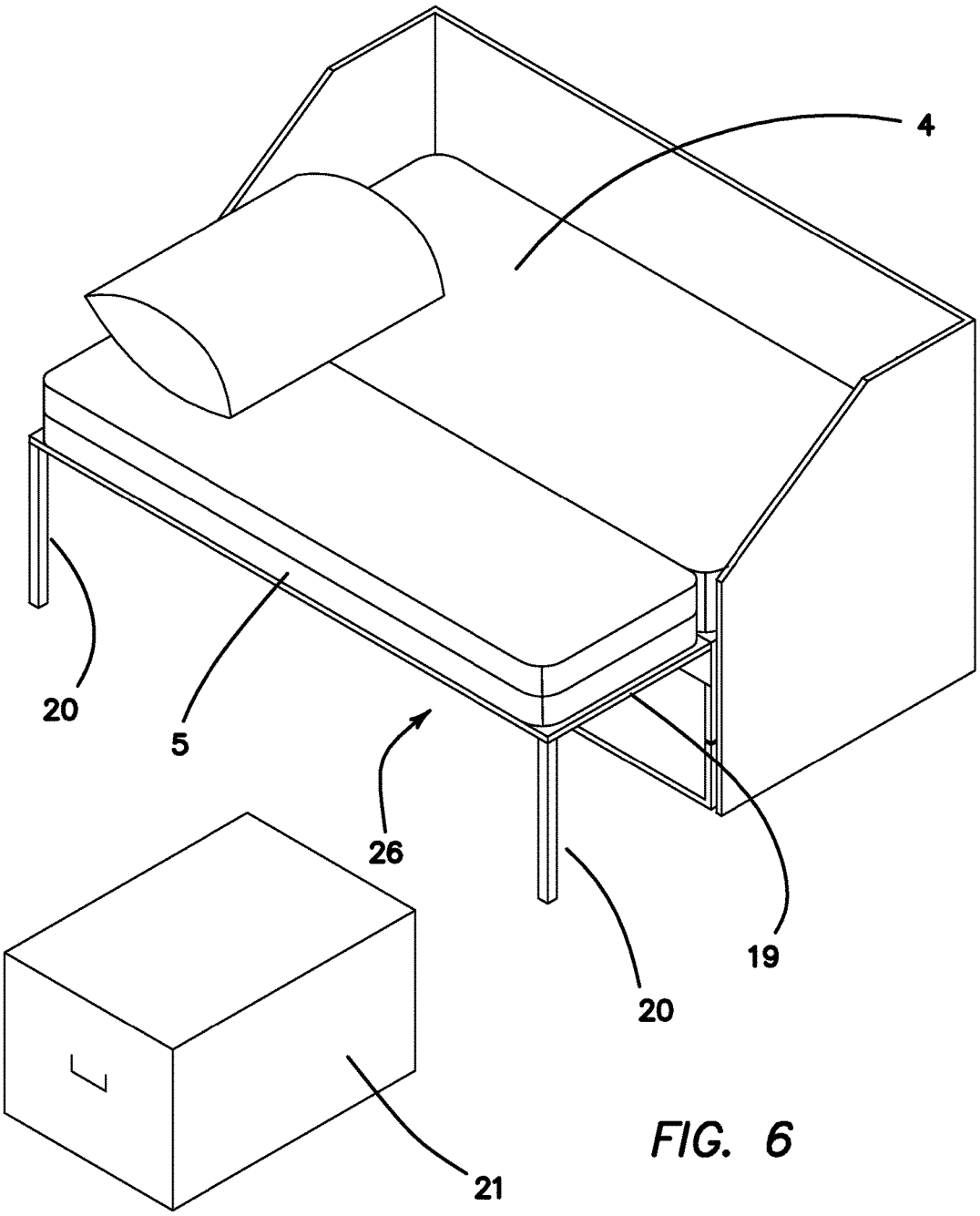
FIG. 6 is a front perspective view of an embodiment of the present invention in an extended bed configuration.

Embodiments of the present invention may further comprise a bed frame extension 26 as shown in FIG. 6. The bed frame extension 26 extends the useable surface area of the bed frame surface 12 so that the foldable mattress topper 5 may be folded and placed on the frame alongside the mattress 4 to form a larger or wider bed. The bed frame extension 26 comprises a supporting surface 19 which is solid or slatted or an open lattice construction. In one embodiment, the supporting surface 19 is solid and is moveable relative to the bed frame surface 12. The supporting surface 19 may be connected to the bed frame surface 12 by a hinge (not shown) so that a user may flip the supporting surface 19 out so that the supporting surface 19 lies in the same plane as the bed frame surface 12. The extended supporting surface 19 is then supported by legs 20 that are pivotally connected to the supporting surface 19 or by support members 21 which may also function as storage containers. The mattress topper 5 is then folded in half and placed on the area of the bed frame 2 and frame extension 19 not covered by the mattress 4. Because the foldable mattress topper 5 is half the thickness of the mattress 4, when the mattress topper 5 is folded, its thickness matches the thickness of the mattress 4.

Figure 7:
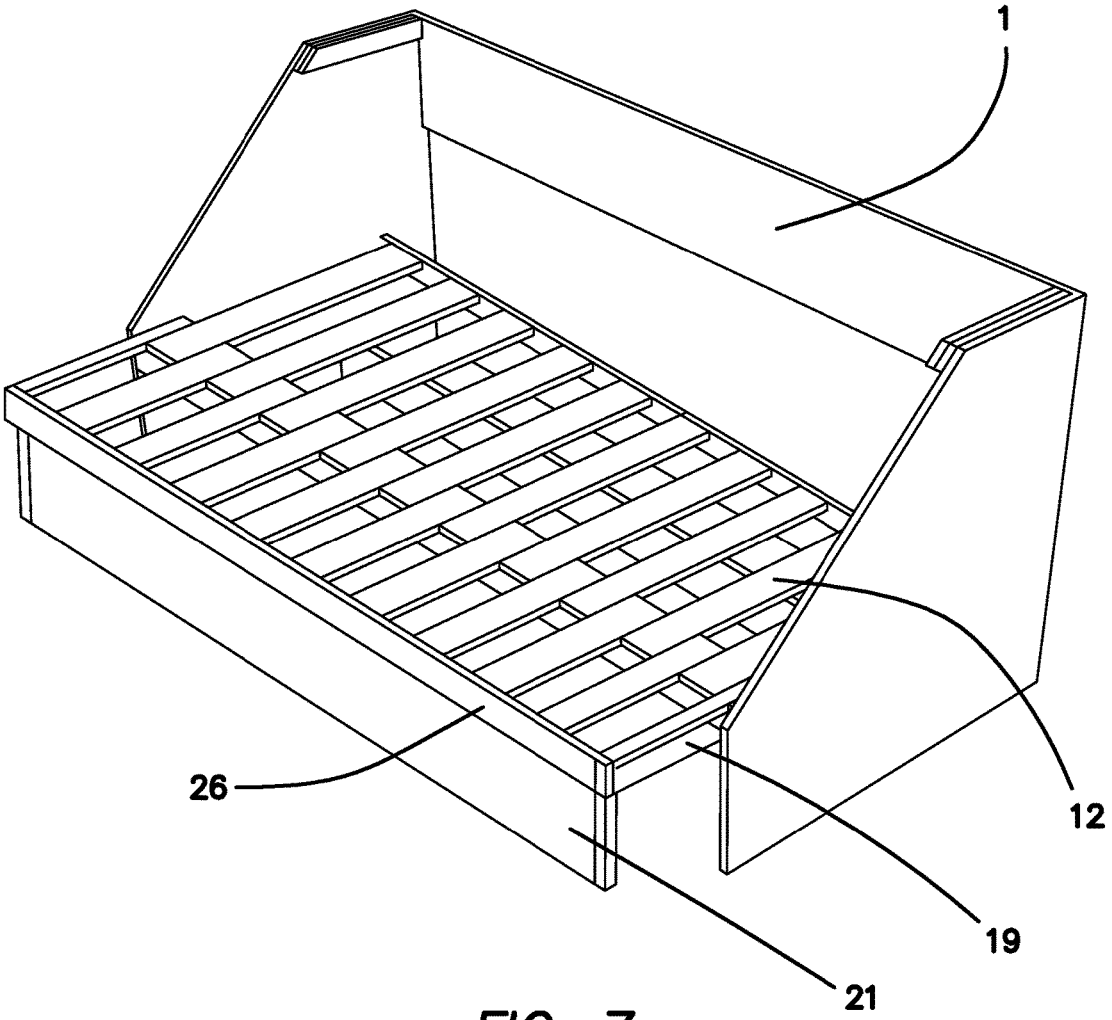
FIG. 7 is a front perspective view of an embodiment of the present invention with a slatted bed frame extension.

FIG. 7 depicts an alternative embodiment where the bed frame surface 12 and the bed frame extension supporting surface 19 are both slatted. The slats of the supporting surface 19 are arranged and configured to slide between the gaps in the corresponding slats of the bed frame surface 12. The supporting surface 19 is then supported by legs 20 or support members 21. The foldable mattress topper 5 is then folded in half and placed on the area of the bed frame 2 and frame extension 19, which area is not covered by the mattress 4.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An item of furniture convertible between day bed, desk, and couch configuration, comprising:

an external box frame having two opposing sides and a backrest and having a low profile consistent with a profile of a conventional couch;

a bed frame rotatably coupled to the external box frame; a configurable mattress-cushion;

a desk rotatably coupled to the bed frame and disposed below the bed frame such that the desk is raised or lowered when the bed frame is raised or lowered respectively;

a first triangular link pivotally connected to the bed frame and the desk;

a connecting rod pivotally connected to the external box frame and the desk;

the bed frame pivotally connected to the external box frame;

wherein the triangular link and a first pivot connecting the connecting rod to the desk are substantially in the same vertical plane;

wherein a bed pivot connecting the bed frame to the external box frame and a second pivot connecting the connecting rod to the external box frame are substantially in the same plane; and the bed pivot located within a perpendicular flange extending above a horizontal upper surface of the bed frame;

wherein a first lowered configuration the bed frame serves as a supporting surface for a day bed and the convertible mattress-cushion is positioned horizontally as a mattress, and wherein a second lowered configuration the bed frame serves as a seating surface for a couch and the convertible mattress-cushion is folded and positioned as a backrest; and wherein a raised configuration the bed frame is rotated into a vertical storage position and the desk is raised to a desk height within the box frame while remaining horizontally oriented.

2. The item of furniture of claim 1, wherein the mattress-cushion is comprised of two equal-sized sections of cushioning connected along a lengthwise edge by a foldable connection such that the mattress-cushion may fold in half lengthwise.

3. The item of furniture of claim 2, wherein the mattress-cushion is further comprised of:

a first layer of viscoelastic foam; and a second layer of foam having a higher indentation force deflection score than the first layer.

4. The item of furniture of claim 1, further comprising:

a bed frame extension surface movable relative to the bed frame; and at least two support legs pivotally attached to the bed frame extension surface.

5. The item of furniture of claim 1, further comprising:

a bed frame extension surface; and a support member moveable relative to the bed frame including one or more storage containers such that the bed frame extension may rest on top of the support member coplanar with the surface of the bed frame.

6. A furniture convertible between a day bed, desk, and couch, comprising:

an external frame;

a bed frame rotatably coupled to the external frame;

a desk rotatably coupled to the bed frame such that the desk is raised or lowered when the bed frame is raised or lowered respectively and such that the desk remains horizontally oriented while it is being raised or lowered;

a first triangular link pivotally connected to the bed frame and the desk;

a connecting rod pivotally connected to the external box frame and the desk;

the bed frame pivotally connected to the external frame;

wherein the triangular link and a first pivot connecting the connecting rod to the desk are substantially in the same vertical plane;

wherein a bed pivot connecting the bed frame to the external frame and a second pivot connecting the connecting rod to the external frame are substantially in the same plane; and the bed pivot located within a perpendicular flange extending above a horizontal upper surface of the bed frame; and a mattress and a foldable mattress topper;

a bed frame extension capable of being coupled to the bed frame; and a supporting member for supporting the bed frame extension, wherein the furniture has a couch configuration wherein the foldable mattress topper is repositioned as a backrest, the bed frame extension and the supporting member such that the mattress and the foldable mattress topper are capable of being configured to form a larger sleeping area in a bed configuration.

7. The furniture of claim 6, wherein the foldable mattress topper is comprised of:

two equal-sized sections of cushioning joined by a foldable connection along a lengthwise edge, wherein each section has a thickness equal to half of the thickness of the mattress, and wherein the two equal-sized sections of cushioning fully cover the mattress when unfolded.

8. The furniture of claim 7, wherein the foldable mattress topper further comprises:

a first layer of viscoelastic foam in each of the two equal-sized sections;

a second layer of foam having a higher indentation force deflection score than the first layer in each of the two equal-sized sections.

9. The furniture of claim 6 further comprising a hinge connecting the bed frame extension to the bed frame.

10. The furniture of claim 6 wherein the bed frame extension is a slatted surface that slides out of the bed frame.

11. A furniture convertible between a bed, desk, and couch, comprising:

an external frame having two opposing side walls and an inner wall;

a bed frame pivotally connected to the external frame;

a mattress placed on the bed frame;

a desk, having a rectangular surface extending from the inner wall;

a first triangular link pivotally connected to the bed frame and the desk;

a connecting rod pivotally connected to the external frame and the desk;

wherein the triangular link and a first pivot connecting the connecting rod to the desk are substantially in the same vertical plane;

wherein a bed pivot connecting the bed frame to the external frame and a second pivot connecting the connecting rod to the external frame are substantially in the same plane; and the bed pivot located within a perpendicular flange extending above a horizontal upper surface of the bed frame; and a foldable mattress topper;

wherein the furniture is capable of assuming a couch configuration when the foldable mattress topper is folded and placed against the inner wall of the external frame and on top of the mattress when in a bed configuration.

12. The furniture of claim 11, wherein the foldable mattress topper is comprised of:

two equally sized sections of cushioning attached along a lengthwise edge by a foldable connection, wherein each section has a thickness of half the thickness of the mattress, and wherein the two equally sized sections of cushioning fully cover the mattress when unfolded.

13. The furniture of claim 12, wherein the foldable mattress topper further comprises:

a first layer of viscoelastic foam in each of the two equally sized sections; and a second layer of foam having higher density than the first layer in each of the two equally sized sections.

14. The furniture of claim 12, wherein the foldable mattress topper further comprises:

a first layer of viscoelastic foam in each of the two equally sized sections; and a second layer of foam having a higher indentation force deflection than the first layer in each of the two equally sized sections.

15. The furniture of claim 11, further comprising:

a bed frame extension surface moveable relative to the bed frame; and at least two support legs pivotally attached to the bed frame extension surface;

wherein the foldable mattress topper is capable of being configured to form a larger sleeping area on the bed frame and bed frame extension surface.

16. The furniture of claim 11, further comprising:

a bed frame extension surface moveable relative to the bed frame; and at least one support member to maintain the bed frame extension surface coplanar with the bed frame when moved to the deployed configuration.

* * * * *